US006113459A

United States Patent [19]

Nammoto

[11] Patent Number: 6,113,459

[45] Date of Patent: Sep. 5, 2000

[54] REMOTE TOY STEERING MECHANISM

[76] Inventor: Mikio Nammoto, 45 Alhambra Cir. #5, Coral Gables, Fla. 33134

[21] Appl. No.: 09/216,785

[22] Filed: Dec. 21, 1998

[51] Int. Cl.[7] ..... A63H 30/00

[52] U.S. Cl. ..... 446/454; 446/456; 446/431

[58] Field of Search ..... 446/431, 454, 446/456, 460, 468; 200/61.47, 61.85; 340/815.6

[56] References Cited

U.S. PATENT DOCUMENTS

| | | | |
|---|---|---|---|
| 3,392,485 | 7/1968 | Asano | 446/454 |
| 4,331,849 | 5/1982 | Wolf | 446/454 |
| 4,695,266 | 9/1987 | Hui | 446/454 |
| 4,817,948 | 4/1989 | Simonelli | 446/456 |
| 4,964,265 | 10/1990 | Young . | |
| 5,024,626 | 6/1991 | Robbins et al. | 446/454 |
| 5,150,027 | 9/1992 | Suzuki . | |
| 5,240,451 | 8/1993 | Clark, Jr. | 446/431 |
| 5,315,515 | 5/1994 | Schmitz . | |
| 5,452,901 | 9/1995 | Nakada et al. | 446/454 |
| 5,551,524 | 9/1996 | Yamamoto et al. . | |
| 5,715,902 | 2/1998 | Petrovich et al. . | |

*Primary Examiner*—Sam Rimell
*Attorney, Agent, or Firm*—Malloy & Malloy, P.A.

[57] ABSTRACT

A steering assembly for vehicles, particularly toy vehicles including a remote control assembly having a steering mechanism mounted thereon in the form of a steering wheel or yoke being manually rotatable wherein movement of the steering wheel causes a proportionate movement in a steering effectuator mounted on the vehicle thus replicating or closely representing the steering operation or "feel" of a conventional vehicle. A plurality of cam lobes are mounted on and move with the steering mechanism and serve to activate a cam following switch which is connected to electronic control circuitry which is designed to effectively control the steering effectuator of the vehicle by generating a fixed number of pulses of a predetermined duration so as to accomplish a discrete change in steering position with each generated pulse in order to closely represent the steering operation of a conventional vehicle. The remote control assembly may be connected to the vehicle by electric wires wherein the generated pulses may be of sufficient power to operate a steering motor associated with the steering effectuator of the vehicle. The remote control may be alternately connected by radio signals such that the generated pulses would signal a companion electronic circuit in the vehicle, which in turn sends pulses of sufficient power to the steering motor of the steering effectuator of the vehicle.

20 Claims, 3 Drawing Sheets

REMOTE TOY STEERING MECHANISM

BACKGROUND OF THE INVENTION

1. Field of the Invention

The present invention is directed to a steering assembly for a remotely controlled vehicle, preferably a toy vehicle, wherein a steering wheel or like steering mechanism is manually rotatable and further wherein the assembly is specifically designed to produce proportionate steering movement of the vehicle upon the manual movement or rotation of the steering wheel associated with a remote control assembly. The remote control assembly may be connected to the vehicle by electric wires or communicate by means of radio signals while, producing the same realistic "feel" in the steering operation of the toy vehicle.

2. Description of the Related Art

Remotely controlled toy or model type vehicles are well known and extremely popular with children as well as those involved in the hobby of model building and model competition. Toy or model vehicles involved in such areas include land, air and water traveling vehicles which are normally structured to closely represent full size, conventional vehicles of the same type.

In the remotely controlled operation of such vehicles, various steering mechanisms are utilized which regulate the actual directional movement or travel of the vehicle. In the area of land or ground traveling vehicles such as model cars, trucks, etc. remote steering mechanisms exists which are frequently connected to the toy or model vehicle by an electric cable or wire. Such a steering assembly therefore requires the operator to physically follow the vehicle in order to maintain control as the vehicle moves along a predetermined path of travel. Alternately, remote control assemblies exist which establish remote control of the vehicle through the transmission of radio or other signals. In the latter category especially, the remote control mechanism manipulated by the operator normally comprises one or more "joy sticks" which do not closely approximate a true method of steering of the vehicle and therefore do not provide the operator with an accurate or real life "feel" of steering the vehicle. Accordingly, it is recognized that there is a clear distinction between the "feel" an operator experiences when steering a remotely controlled vehicle than when involved in the steering operation of a conventional, full size vehicle of the same type.

In light of the disadvantages associated with a large number of steering mechanisms and assemblies for the remote control of a variety of different types of vehicles, attempts have been made to improve the realistic steering operation or control of the vehicles. More specifically remote control assemblies do exist which incorporate a manually rotatable steering wheel mechanism. However, such existing remote control steering devices normally allow only a limited amount of movement in each of two opposite rotational directions. Typically, known steering wheel mechanisms associated with remote control devices only operate through a range of movement of approximately twenty degree in each direction from center. Therefore, the remote control devices which implement a steering wheel will typically function with a movement equivalent to that associated with the manipulation of a joy stick. On the other hand, joy stick steering or control mechanisms are implemented through the provision of a plurality of on/off switches or variable resisters. Movement of the joy stick of a conventional control assembly causes a steering motor to operate in either an on/off fashion or at an increasingly high speed as the joy stick or other similar steering mechanism is moved or turned to the limits of its range of movement.

A review or survey of commercially available, remote controlled assemblies, including steering systems, reveals steering mechanisms operating with the above noted type of disadvantages. For example, in some remote control devices, the steering assembly and/or mechanism associated therewith includes a steering wheel that turns approximately 20 degrees in either direction from its center position. Accordingly, the steering mechanism in effect functions as an on/off switch. This unrealistic steering movement of course differs from conventional true size steering assemblies associated with a variety of other similar type vehicles. Typically, in a conventional, full size vehicle a steering wheel causes the steering movement of the steering effectuator to take place in direct proportion to the movement of the steering wheel in order to provide the operator with an accurate feel of the direction of travel of the vehicle. In real size vehicles, the more the steering wheel or other mechanism is turned in a given direction, the more the vehicle turns in a corresponding direction and in what is usually a fixed ratio of steering motion to turning motion. For example, in true size vehicles, steering wheels typically turn from one to three full rotations to cause the steering effectuator of the vehicle to move through its full range of travel.

Related art also exists which is directed to and includes the design of specific circuitry intended for the digitizing of a signal in a remote control device. Such known, related devices do not suggest the more advantageous means of generating a control signal from a human operator through a plurality of interactive components which provide a more realistic feel of the steering operation and movement. In addition to the above, radio or roboticaly controlled steering devices are also known for the control of conventionally sized vehicles including utilitarian devices such as lawn mowers and/or recreational or work related devices such as scooters or the like. Such devices can be operated either manually, in a conventional manner or remotely, for a variety for specific applications.

Based on the above there is, however, still a need in this area for a remote control assembly specifically designed to regulate, control and operate a vehicle and in particular, a toy or model vehicle wherein the vehicle may be designed to travel over a land or ground surface or alternately to travel over water or in the air. Such a preferred assembly should preferably be designed to provide proportional, discrete, increments of movement of the steering effectuator or like device mounted on the vehicle so as to correspond, in a realistic fashion, to the manual movement of a steering wheel or like steering mechanism associated with or mounted on the remote control assembly.

SUMMARY OF THE INVENTION

The present invention is directed towards a steering assembly for a remotely controlled vehicle such as a toy or model vehicle and including a remote control assembly intended to be manipulated by an operator and which has mounted thereon a steering wheel or other equivalent structure such as a rotatable yoke. More specifically, the assembly of the present invention is specifically designed such that manual rotation of the steering wheel or like steering mechanism, associated with the remote control, causes a proportionate movement of the steering effectuator of the vehicle thereby closely representing the steering operation and movement of a real size vehicle which the toy or model vehicle is intended to imitate. The operator of the subject remote control assembly and particularly the steering assembly associated therewith is thereby provided a more realistic "feel" when steering the vehicle, thereby enhancing the enjoyment of the remote operation of the vehicle.

The steering assembly of the present invention provides for proportional movement of the steering wheel associated with the remote control assembly and the attendant steering effectuator mounted on the toy vehicle. In addition, the number of turns of the manually operable steering wheel can easily be set to match the conventional number of turns associated with a true size steering wheel of a conventional size vehicle which the toy vehicle is designed to mimic. Such proportional movement and discrete positioning of the steering effectuator of the vehicle is accomplished through the generation of an output of electronic control circuitry in the form of a series of discrete pulses. These discrete pulses are preferably generated when a plurality of cam lobes, mounted on the supportive shaft of the steering wheel and extending readily outward therefrom, engage a cam following switch disposed in actuating, engageable relation to the plurality of cam lobes. In this manner the cam following switch is activated to the extent that the switch state changes only as the steering wheel is turned and not when the steering wheel is stationary. The aforementioned production of a plurality of generated discrete pulses are produced as the wheel is continuously turned. The cam follower switch signals the electronic control circuitry which in turn controls and/or regulates the aforementioned vehicle mounted steering effectuator responsive to the electronic control circuitry. The steering effectuator may comprise a drive motor or like mechanism associated with the steering of the vehicle such as a steering motor and/or other mechanical linkage. The remote control assembly on which the steering mechanism, preferably in the form of the steering wheel, is mounted may be connected to the vehicle by electric wires. The pulses generated by the electronic control circuitry may be of sufficient power to operate the steering motor via the connecting wires wherein the steering motor as set forth above, is part of the steering effectuator serving to direct the vehicle. An alternate embodiment of the present invention comprises the steering assembly associated with the remote control assembly structured to regulate the steering effectuator of the vehicle by radio signals or other signals. In such an embodiment, the pulses will signal a companion electronic circuit mounted on or associated with the toy vehicle, which in turn would generate a pulse of sufficient power to drive the steering motor.

The steering wheel or like steering mechanism of the present invention is designed to be manually rotated in each of two opposite direction. The directions of rotation is sensed and indicated by one or more direction indicating switches disposed in spaced relation to the steering mechanism on the remote control assembly. The switches are further disposed in operative, engageable relation to a cam member mounted on the steering shaft of the steering mechanism and rotatable, at least to an extent, therewith. This cam member is fractionally mounted so as to establish a slip-fit to the steering shaft. Upon rotation of the steering shaft, the cam member will engage the switch causing its activation. However, upon reaching a stop member, the cam member can be held stationary while the steering shaft of the steering mechanism continuous to travel in a given direction. The cam member is blocked so that it travels within a relatively short arc segment of the steering wheel's path of travel. In this manner, the cam member quickly encounters one of two direction switches, each time the direction of wheel's rotation is changed. The direction switches associated with the directional indicator assembly is connected to the electronic control circuitry such that activation of either one of the direction switches will cause a change in direction of the driving motor associated with the steering effectuator of the vehicle. This in turn will cause the mechanical linkage associated therewith to be positioned in a manner which will change the direction of travel of the vehicle.

The plurality of cam lobes associated with the steering regulator assembly as set forth above is associated with the pulse duration of the fixed number of pulses generated by the electronic control circuitry. Accordingly, the steering direction of the vehicle changes in a discrete ratio that would be expected in a real size vehicle which the toy vehicle is designed to imitate. This in turn will produce a realistic "feel" to the operator when the toy is being manipulated. In addition, when the steering wheel, associated with the remote control assembly is not being turned, pulses are not being generated by the electronic control circuitry and no power is applied to the driving motor associated with the steering effectuator of the vehicle. This reduces the power consumption of the vehicle.

There are many potential embodiments of the electronic control circuitry that could be used to carry out the requirements of the present invention. The electronic control circuitry of the present invention may be designed to produce either the signal or power pulse as described above in either positive or negative polarity for the DC drive motors associated with the steering effectuator. Alternately, electronic control circuitry may represent the steering direction on a different signal wire or transmitted channel, for example, to operate a relay that mechanically reverses the steering direction of the toy vehicle. Further, the electronic control circuit is designed so that each signal pulse from the cam follower switch generates one or more power pulses of a predetermined duration. The optimal frequency and duration of power pulses are determined mathematically and/or experimentally to produce a realistic correlation between the movement of the remote steering wheel and the steering effectuator, including the steering drive motor and associated mechanical linkage mounted on the vehicle itself.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
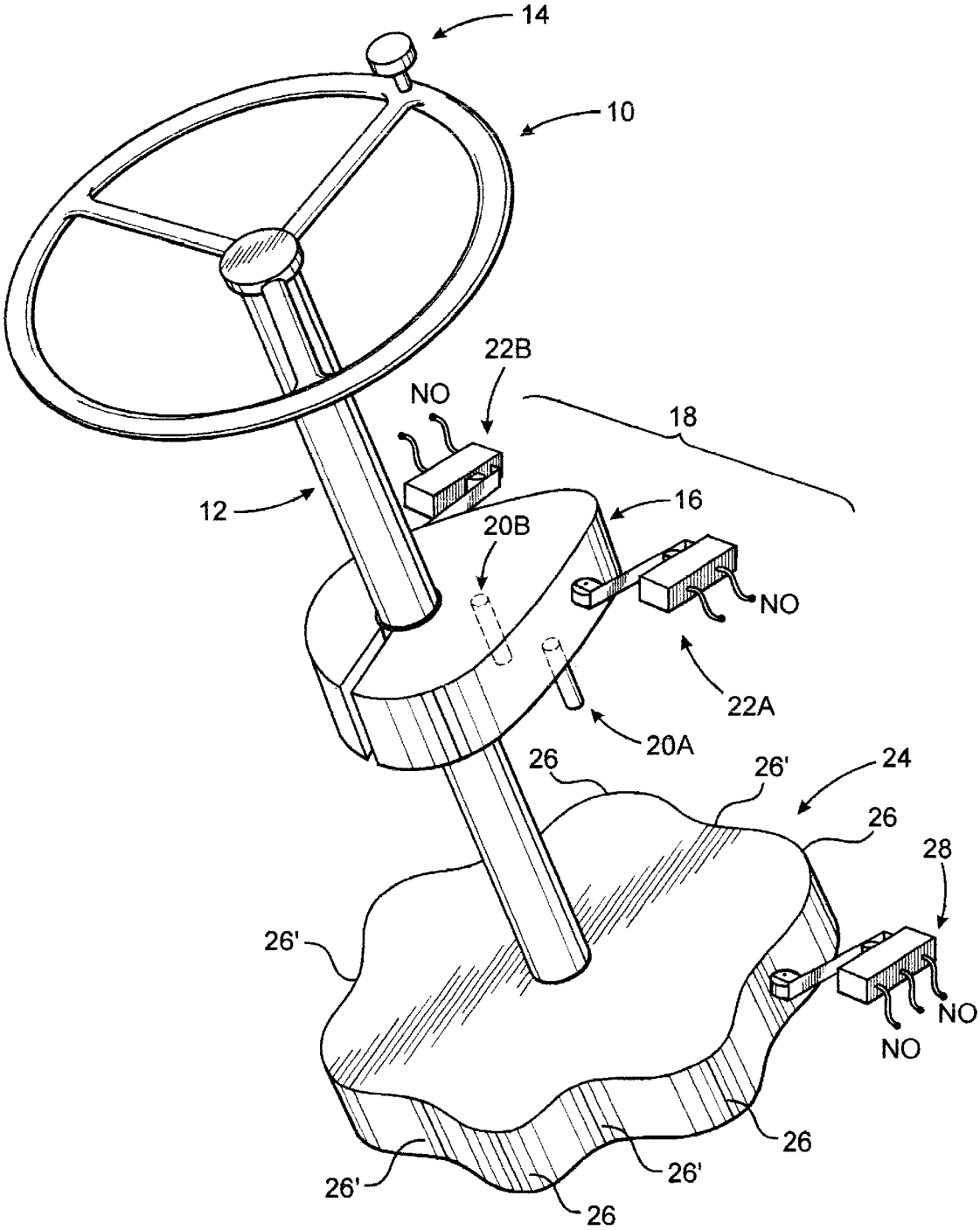
FIG. 1 is a perspective view in partial schematic form representing certain components of the steering assembly of the present invention.

With reference to FIG. 1, a preferred embodiment of the present invention comprises a steering mechanism provided in the form of steering wheel 10 which is axially connected to a steering shaft 12. The steering mechanism, including the steering wheel 10 and steering shaft 12 are mounted on or considered to be a part of a remote control assembly manipulated by an operator and which may be connected to the toy or model vehicle being regulated by means of an electronic cable or wire or by the generation of radio, infrared or other transmitted signals. For purposes of clarity the actual vehicle is not shown in detail. The steering wheel 10 is turned by the operator which has clear access to the remote control assembly by gripping and manually turning the steering wheel 10 or alternately by gripping or otherwise engaging a steering knob 14 mounted thereon. It should be understood that the steering wheel 10 could also be in the form of a yoke such as of the type found on or associated with aircraft or race cars, or any other configuration that would be convenient to manipulate and preferably rotate, by a user.

Further, with regard to FIG. 1, a directional indicator assembly, generally indicated as 18, is included and is structured to provide a signal to an electronic control circuitry 200 (See FIGS. 2 and 3) to indicate the rotational direction of movement or travel of the steering wheel 10 (either right or left). The directional indicator assembly preferably includes a first cam assembly. As the steering shaft 12 turns in connection with the manipulation of the steering wheel 10, the first cam assembly, preferably comprising a first cam member 16, turns with the shaft 12 until the first cam member 16 contacts a fixed stop post 20A or 20B. At this point the first cam member 16 stops while the steering shaft 12 and steering wheel 10 continue to rotate in the same direction. In either stop position, the steering shaft 12 is free to continue to rotate while the first cam member 16 serves to activate switch 22A or 22B depending upon the direction of rotation of the steering shaft 12. Switches 22A and 22B may be referred as to a first direction switch and a second direction switch, respectively. The output of the first and second direction switches 22A and 22B are connected to the electronic control circuitry 200 such that the electronic control circuitry causes the steering effectuator (See FIGS. 4A and 4B) to change direction. This is preferably accomplished by changing the output polarity of the output switches 22A and 22B. At all degrees of rotation of the steering shaft 12, one and only one of the first and second direction switches 22A or 22B is closed. In the embodiment shown in FIG. 1, the first and second direction switches 22A and 22B are normally open (NO). It should be understood, however, that the electronic control circuitry 200 could contain logic to decode the operation of a single switch 22A or 22B, but in the preferred embodiment, two direction switches are used to simplify the design and cost of the electronic control circuitry 200.

Figure 4B:
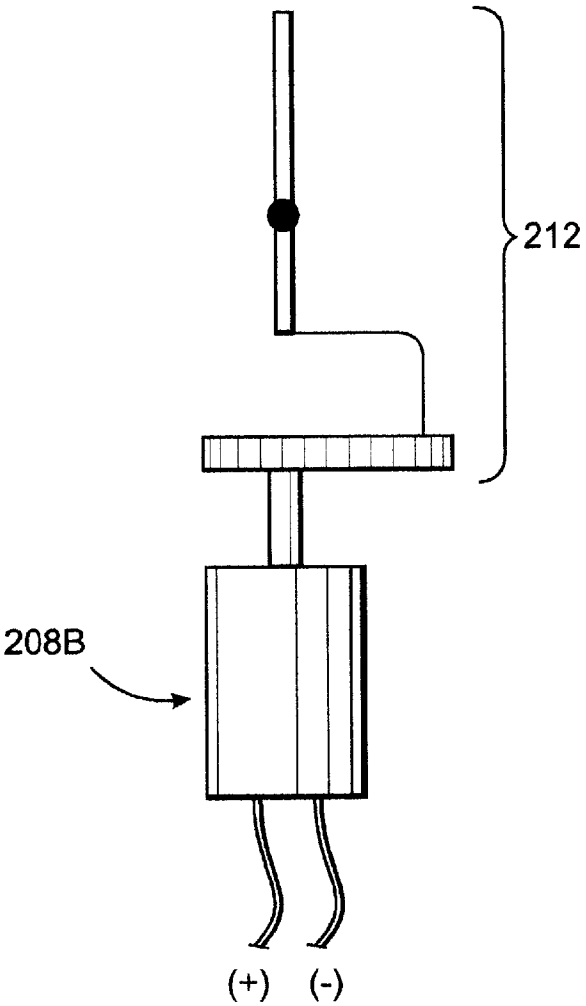
FIG. 4B is a schematic representation of another embodiment of a steering effectuator associated with a remote control vehicle.
Figure 4A:
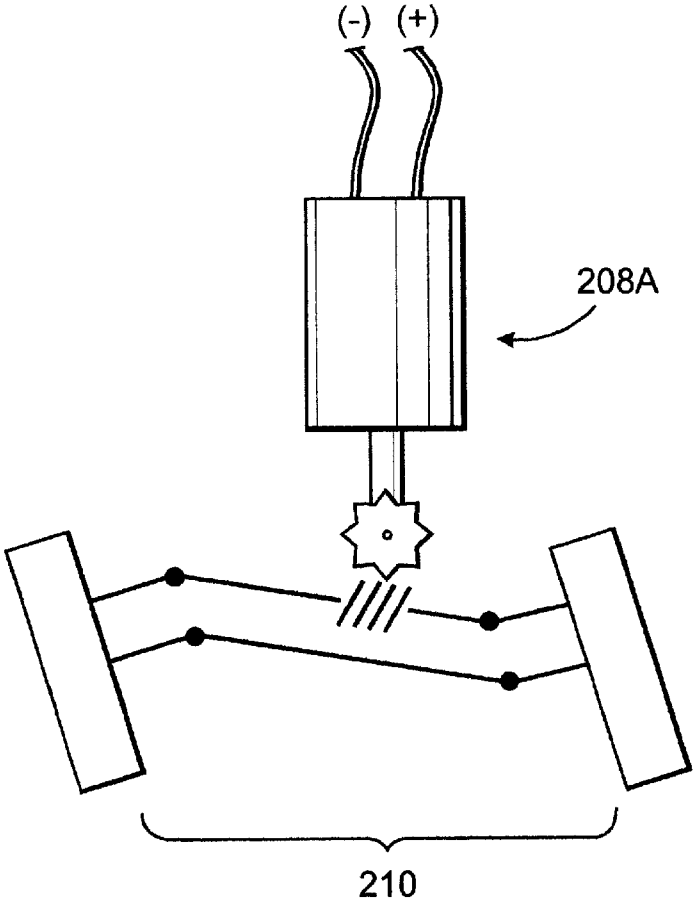
FIG. 4A is a schematic representation of one embodiment of a steering effectuator associated with a remote control vehicle.

The present invention further includes a steering regulator assembly comprising a second cam assembly including a second cam member 24 having at least one cam lobe, but most preferably a plurality of cam lobes 26, arranged in continuous fashion to one another as shown in FIG. 1. A cam following switch 28 defines a second switching assembly that is disposed to switch or "change state" with the passing of each of the plurality of such cam lobes 26 relative thereto. In the embodiment shown in FIG. 1, switch 28 is open when following a cam lobe 26, and closed when following a cam depression 26'. The electronic control circuitry 200 produces one or more discrete pulses of a predetermined duration for each change in state of the switch 28. In this manner the operator can stop turning the steering wheel 10 at any point, and the steering effectuator, mounted on the vehicle, as shown in FIG. 4A or 4B would also stop moving. Of course, it is noted that a variety of cam lobe and switch structures could also be provided, the cam lobes including a plurality of prongs or triggers or magnetic elements, and the switch being of a corresponding configuration to change states in order to signal a pulse or to actually be on while engaged to signal a continuous pulse. The described embodiment is, however, preferred for the preceding reason wherein stoppage of the wheel at any location, including a switch engaging location, will not result in continued turning.

Pursuant to the preferred embodiment wherein it is the change in state of switch 28 that causes the electronic control circuitry 200 to generate the pulse output, it is therefore the particular requirements of the electronic control circuitry 200 to be designed to determine whether the switch 28 should be in an open or closed position relative to the engagement with the individual cam lobes 26 and/or depression 26'. The number of cam lobes 26, the duration of the pulses produced in the electronic control circuitry 200 and the number of pulses per cam lobe produced by the electronic control circuitry 200, as well as the speed of steering motors 208A and/or 208B associated with the steering effectuator of FIGS. 4A and 4B and the linkage 210 and 212 respectively which they control, determine the correlation between the rotation of the steering wheel 10 and steering direction and the amount of change of such steering direction of the vehicle. Any or all of these elements may be varied or regulated to affect a desired steering "feel" with the goal being, a replication of the steering operation of a real size vehicle.

The design of the electronic control circuitry 200 is thus modified using methods known in the electronic arts so that the duration of each pulse, and the number of pulses for each change in the state of switch 28 are determined empirically or mathematically so that the steering wheel 10 regulates the output of the steering motor 208A or 208B, associated with the aforementioned steering effectuator of the vehicle, to generate movement of the steering effectuator 210 or 212 which is representative of the steering of a real life vehicle.

Figure 3:
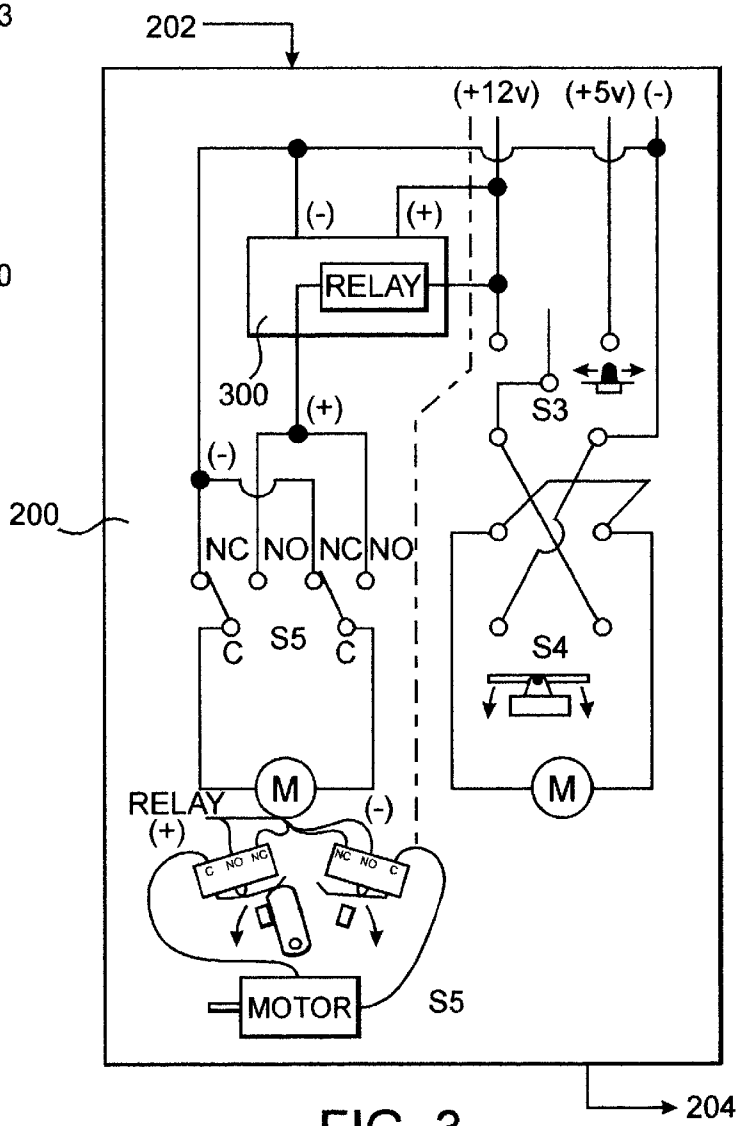
FIG. 3 is a schematic representation in block form of one embodiment of the electronic control circuitry of the present invention.
Figure 2:
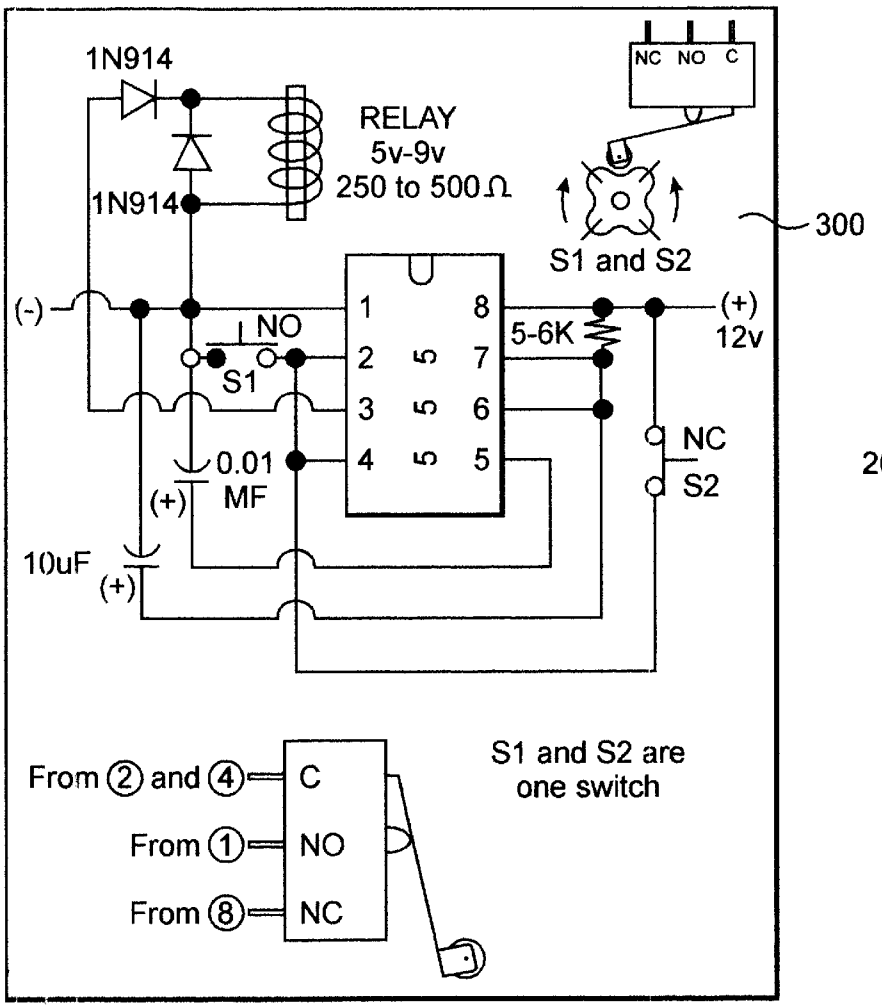
FIG. 2 is a schematic view in block form of circuitry details of an electronic control circuitry of FIG. 3 which is associated with a operation of the steering assembly of the present invention.

By way of example, FIGS. 2 and 3 represents an electronic control circuitry 200 adapted from the Radio Shack Engineer's Mini-Notebook, catalog number 276-5010A page 9, entitled "Timer Plus Relay". The operation of the electronic control circuitry of FIG. 3 is understood by one skilled in the electronic art and as further explained in the above-noted reference. As shown in FIG. 2, a portion of the electronic control circuitry 200 is shown in detail and is represented as 300. Further, electronic control circuitry 200 could be disposed inside the remote control assembly manipulated by the operator, with the output 204 connected to the steering effectuator of the steering motors 208A or 208B by electric wires. Alternately, the electronic control circuitry 200 could produce an output signal, connected to a radio transmitter. In this latter embodiment, a receiver within the toy vehicle would produce a corresponding power signal in the steering motor 208A or 208B associated with the steering effectuator of FIGS. 4A and 4B. In the illustrated embodiment, steering motor 208A is preferably shown to operate a mechanical linkage in the form of a rack and pinion steering linkage 210. Steering motor 208B is shown to operate a rudder type mechanism 212, which collectively defines the second embodiment of the steering effectuator of FIG. 4B such as would be found in a remote control model or toy marine craft or airplane. It should understood that the invention could be used in all manner of toy or model vehicles, where a steering wheel or like steering mechanism would be found in the associated or imitated real size world vehicle, which the toy vehicle is intended to imitate.

If desired, a variety of mechanical or electronic means can be employed to interrupt power to steering motor 208A or 208B of FIGS. 4A and 4B respectively, at the end of the steering travel, such as a lack of gear thread at the steering limit in a gear and pinion mechanism or other electronic mechanical means at the end of the steering travel.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A steering system for a remotely control vehicle comprising:

a) a remote control assembly structured to regulate movement of the vehicle and including, a steering mechanism structured to be manually moveable in accordance with an intended direction of travel of the vehicle, b) a direction indicator assembly mounted at least partially on said steering mechanism and structured to determine a change in direction of the movement of said steering mechanism, c) a steering regulator assembly connected to said steering mechanism and at least partially moveable therewith, d) said steering regulator assembly structured to regulate a direction of travel of the vehicle, e) electronic control circuitry responsive to said steering regulator assembly to generate an output designed to produce steering movement of the vehicle proportionate to the manual movement of the steering mechanism, and f) a steering effectuator mounted on the vehicle and responsive to said electronic control circuitry and structured to effect discrete changes in the steering position of the vehicle based on the output of said electronic control circuitry.

2. An assembly as recited in claim 1 wherein said steering mechanism is structured for rotational movement in both of two substantially opposite directions.

3. An assembly as recited in claim 2 wherein said directional indicator assembly is structured to determine and indicate to said electronic control assembly a change in rotational direction of said steering mechanism.

4. An assembly as recited in claim 3 wherein said directional indicator assembly is mounted to move with said steering mechanism within predetermined limits and further to allow movement of said steering mechanism relative thereto beyond the predetermined limits.

5. An assembly as recited in claim 2 wherein said directional indicator assembly comprises:

a) a first cam assembly including a first cam member mounted on said steering mechanism to rotate therewith in both of the two opposite directions;

b) a first switch assembly connected to said electronic control circuitry and disposed in cooperative relation to said first cam member for activation thereof upon rotational movement of said steering mechanism in an opposite direction, and c) said electronic control circuitry structured to generate output to reverse the direction of said steering effectuator.

6. An assembly as recited in claim 5 wherein said steering mechanism comprises a steering wheel and a shaft connected to said steering wheel for rotational movement therewith; said first cam member mounted on said shaft for rotational movement thereof.

7. An assembly as recited in claim 6 wherein said first switch assembly is disposed in adjacent, spaced relation to said shaft and in engageable relation with said first cam member.

8. An assembly as recited in claim 7 wherein said first cam member and said first switch assembly are cooperatively disposed and structured to activate said first switch assembly for each change in rotational direction of said shaft.

9. An assembly as recited in claim 8 further comprising means for limiting rotational travel of said first cam member relative to said shaft.

10. An assembly as recited in claim 2 wherein said steering regulator comprises a second cam assembly connected to said steering mechanism for rotation therewith and a second switch assembly disposed in spaced relation to said steering mechanism and in activating engagement with said second cam assembly; said second switch assembly cooperatively disposed and structured with said electronic control circuitry to cause the generation of a fixed number of pulses of a predetermined duration by said electronic control circuitry upon activation of said second switch assembly by said second cam assembly.

11. An assembly as recited in claim 10 wherein second cam assembly comprises a second cam member mounted on said shaft and moveable therewith; said second cam member comprising a plurality of cam lobes disposed in engageable, activating relation to said second switch assembly.

12. An assembly as recited in claim 11 wherein said second cam member is cooperatively structured and disposed to change a switch state of said second switch assembly each time one of said plurality of cam lobes engages said second switch assembly.

13. An assembly as recited in claim 12 wherein said electronic control circuitry is structured to generate an output defined by a fixed number of electronic pulses of predetermined direction for each change in switch state.

14. An assembly as recited in claim 13 wherein said steering effectuator is structured to make a discrete change in steering position with each pulse from said electronic control circuitry.

15. A steering system designed for a remotely controlled vehicle comprising;

a) a remote control assembly structured to regulate movement of the vehicle and including a steering wheel, b) a shaft axially connected to said steering wheel and moveable therewith, c) said steering wheel and said shaft structured for rotational movement in both of two opposite directions in accordance with an intended direction of travel of the vehicle, d) a plurality of cam lobes mounted on said shaft and moveable therewith; said plurality of cam lobes extending outwardly from said shaft, e) a cam following switch disposed in engageable relation with said plurality of cam lobes and structured to change switch state each time one of said plurality of cam lobes is encountered by said cam following switch, f) electronic control circuitry responsive to said cam following switch and structured to generate a fixed number of electric pulses of predetermined duration for each change in switch state, g) a directional indicator assembly mounted on said shaft to move therewith and structured to indicate to said electronic control circuitry a change in rotational direction of said steering wheel and said shaft, and h) a steering effectuator responsive to said electronic control circuitry and mounted on said vehicle; said steering effectuator structured to make a discrete change in steering position with each pulse of said electronic control circuitry.

16. An assembly as recited in claim 15 wherein said directional indicator assembly comprises a direction switch assembly connected to and cooperatively structured with said electronic control circuitry to generate an output to reverse the direction of said steering effectuator each time said direction switch assembly is activated.

17. An assembly as recited in claim 16 wherein said direction indicator assembly further comprises a first cam member mounted on said shaft in activating relation to said direction switch assembly and disposed and structured to activate said direction switch assembly.

18. An assembly as recited in claim 17 wherein said first cam member is mounted on said shaft and structured to rotate therewith and move relative thereto.

19. An assembly as recited in claim 18 further comprising means for limiting rotational travel of said first cam member relative to said shaft.

20. An assembly as recited in claim 17 wherein said direction switch assembly comprises a first direction switch and a second direction switch each connected to said electronic control circuitry; said first and second direction switches relatively disposed to one another and said first cam member so as to be activated by said first cam member when rotating with said shaft in an opposite rotational direction; said first and second direction switches cooperatively structured with said electronic control circuitry to change the output thereof to cause said steering effectuator to turn in opposite directions when either of said first and second direction switches has been activated.

* * * * *